United States Patent [19]

Vogel

[11] 4,247,024

[45] Jan. 27, 1981

[54] AEROSOL CONTAINER VALVE WITH MEANS FOR TAPPING ADDITIONAL GAS

[75] Inventor: Günter M. Vogel, Nuremberg, Fed. Rep. of Germany

[73] Assignee: Aerosol Inventions and Development S.A., Fribourg, Switzerland

[21] Appl. No.: 9,652

[22] Filed: Feb. 5, 1979

[30] Foreign Application Priority Data

Feb. 13, 1978 [FR] France ..... 78 03937

[51] Int. Cl.[3] ..... B65D 83/14

[52] U.S. Cl. ..... 222/402.16; 222/402.18

[58] Field of Search ..... 222/4, 402.16, 402.18, 222/635

[56] References Cited

U.S. PATENT DOCUMENTS

| | | | |
|---|---|---|---|
| 3,375,957 | 4/1968 | Kuffer | 222/402.16 |
| 3,401,844 | 9/1968 | Hanson | 222/635 |
| 3,583,606 | 6/1971 | Ewald | 222/402.18 |
| 4,015,757 | 4/1977 | Meuresch et al. | 222/402.16 |
| 4,062,478 | 12/1977 | Giuffredi | 222/402.16 |

*Primary Examiner*—David A. Scherbel
*Assistant Examiner*—Frederick R. Handren
*Attorney, Agent, or Firm*—Henderson, Farabow, Garrett & Dunner Finnegan

[57] ABSTRACT

The container valve housing is provided with two concentric bearing walls having different heights, the outer bearing wall being fitted with a gasket which is traversed by the valve stem and the inner bearing wall being applied against the gasket so as to form an internal chamber which communicates with the product to be dispensed. An annular wall between the two bearing walls is provided with filler openings and with at least one independent calibrated bleeder orifice or tap for the admission of propellant gas from the headspace of the container into the internal chamber.

6 Claims, 3 Drawing Figures

FIG.1
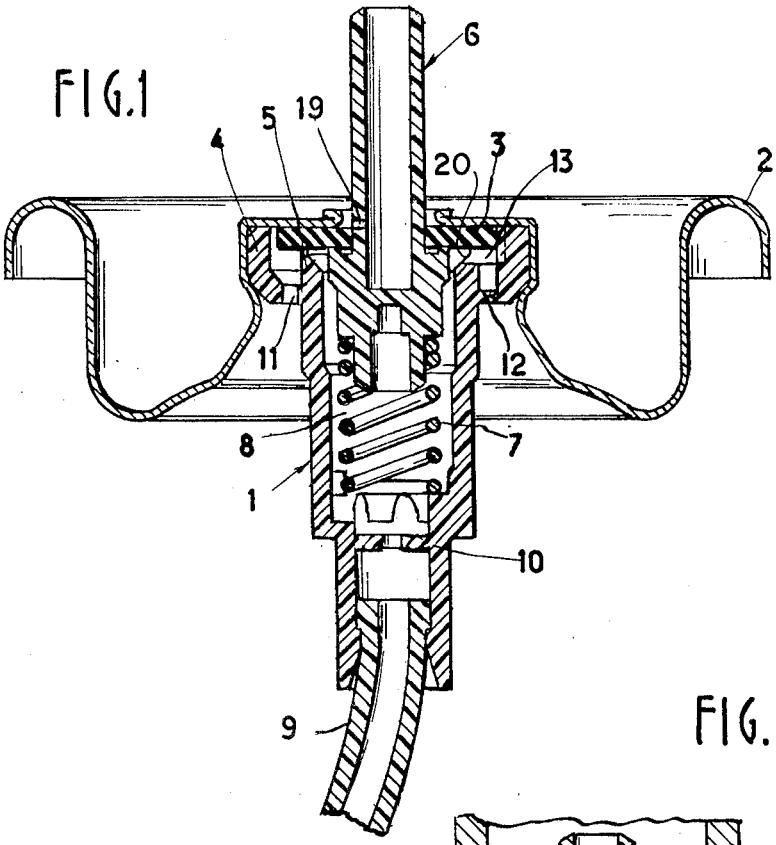
FIG.3
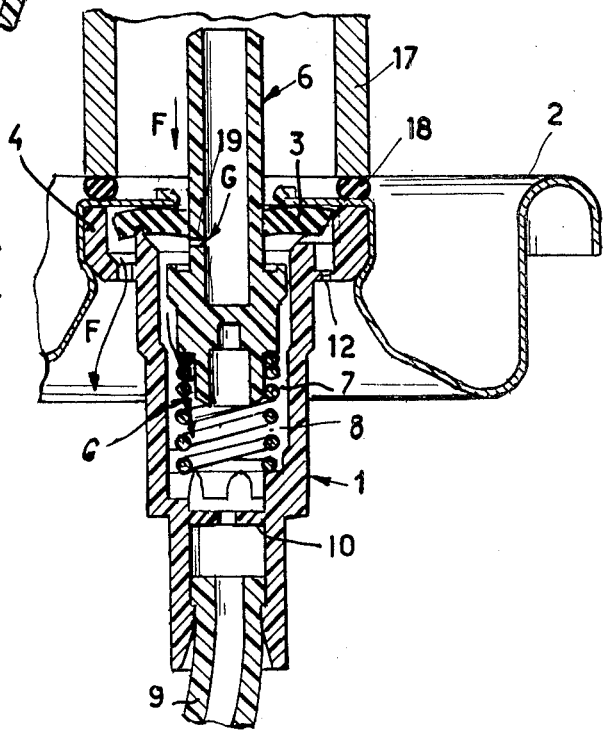
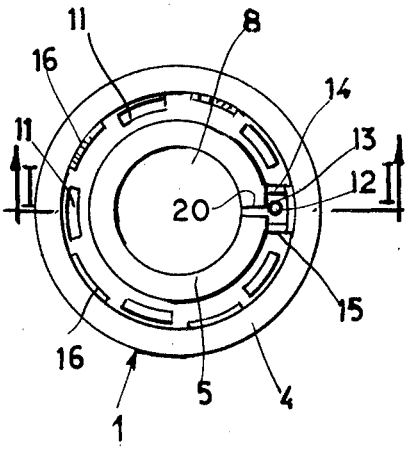
FIG.2

AEROSOL CONTAINER VALVE WITH MEANS FOR TAPPING ADDITIONAL GAS

This invention relates to the pressurized packaging industry and specifically to the packaging of fluid substances.

Valves for tapping additional gas are already known and have the effect of improving spray discharge properties, especially when the propellant consists of butane, propane or a similar gas.

In a typical valve described in U.S. Pat. No. 3,225,969 to O'Donnel, the additional gas tap or bleeder orifice is partially defined by the gasket. In valves of this type, the spray discharge properties vary to a considerable extent according to the rate of flow of additional gas admitted or more specifically according to the cross-sectional area provided for the gas flow. It would therefore appear feasible to remove this objection simply by means of valves designed to provide cross-sectional areas of optimum value for the flow of additional gas. The problem which arises in actual practice, however, lies in the fact that variations are introduced by sealing gaskets of elastic material, both in the assembly of the valves and as a result of mechanical degradation of gaskets in time and possible swelling of these latter in contact with packaged products.

The disadvantage attached to known valves of this type is that they have different characteristics from one valve to another and that the desired optimum standard of operation cannot be ensured at the time of manufacture. Moreover, the structure of such valves does not permit of rapid admission for filling the container.

The primary aim of the present invention is to overcome the disadvantages mentioned in the foregoing.

The invention is accordingly concerned with an aerosol container valve with an additional-gas tap, a valve stem being displaceable by hand in opposition to a restoring spring from a closed position to a temporarily open position. The valve essentially comprises a cup to be crimped on the container in order to maintain a valve housing having two concentric annular bearing walls which are relatively displaced in height. The outer bearing wall is applied directly against said valve cup and contains a gasket which is traversed by the valve stem. The inner bearing wall of the valve housing is applied against the gasket and forms within said housing a chamber which communicates with the product to be dispensed. The annular wall between the two bearing walls is pierced on the one hand by a plurality of openings for filling the container by means of a flow which passes around the gasket and the internal chamber of the valve housing and on the other hand by at least one calibrated orifice for the flow of propellant gas from the headspace of the container into said internal chamber.

In accordance with the invention, arrangements are advantageously made to bring the additional gas as close as possible to the bottom face of the gasket with a view to achieving enhanced valve performance. To this end, the calibrated orifice opens into a separate admission chamber defined between the two bearing walls of the valve housing whilst two transverse walls extend between said bearing walls and the gasket. The admission chamber communicates with the valve housing chamber through a port formed in the inner bearing wall between the radial walls. The cross-sectional area for flow through said port is much greater than that of the calibrated orifice for the propellant gas.

In order to obtain rapid filling of aerosol containers, it appears desirable to ensure that the valve is provided with a plurality of openings. The valve advantageously has five filler openings uniformly spaced along the same circumference between the two annular bearing walls.

A more complete understanding of the invention will be gained from the following detailed description and from the accompanying drawings in which one embodiment of the invention is shown by way of example and not in any limiting sense, and wherein:

FIG. 1 is a sectional front view taken along line I—I of FIG. 2 and showing a valve in accordance with the invention in the closed position;

FIG. 2 is a top view of the housing alone of the valve shown in FIG. 1;

FIG. 3 is a sectional front view of the valve of FIG. 1 during filling of the container.

The valve illustrated in FIGS. 1 to 3 essentially comprises a housing 1 crimped within a valve cup 2 with interposition of a gasket 3 of conventional type for aerosol containers.

The valve housing 1 is provided with two concentric bearing walls 4, 5 having different heights. The gasket 3 is contained laterally and centered by the outer bearing wall 5 whilst the inner bearing wall 4 is applied against said gasket 3 in leak-tight manner.

The gasket 3 is traversed by the tubular valve stem 6 which is urged to the closed position of the valve (FIG. 1) by a restoring spring 7. The valve stem 6 can be displaced by hand in opposition to the spring 7 to a bottom position in which the valve is open, either for the purpose of dispensing the product or for the purpose of filling the container (FIG. 3).

A conventional actuator button with spray discharge nozzle (not shown in the drawings) is fitted on the valve stem 6 for dispensing the product contained in the pressurized pack.

The internal chamber 8 of the valve housing 1 communicates with the product to be dispensed through a dip tube 9 with interposition of a flow-reducer 10 (this feature being optional).

The annular wall of the valve housing 1 between the two concentric walls 4 and 5 is pierced by:

(a) Five filler openings 11 of oblong shape which are uniformly spaced along the same circumference between the two annular bearing walls;

(b) A calibrated orifice 12 for admitting the propellant gas which constitutes additional gas and is contained within the free internal space or so-called headspace of the container.

As shown in FIGS. 1 and 2, the calibrated orifice 12 opens into an admission chamber 13 formed between the bearing walls 4, 5 by two transverse walls 14, 15 beneath the gasket 3. A port 20 cut in the edge of the inner bearing wall 5 establishes a communication between the admission chamber 13 and the valve housing chamber 8.

The gasket 3 is centered in the outer bearing wall 4 by means of a plurality of bosses 16 spaced between the filler openings 11 so as to define a free space opposite to each opening. Bosses 16 are intended to ensure centering of gasket 3 and to permit the flow of propellant gas between the spaces formed by the intervals between bosses 16 for the purpose of filling a container fitted with the valve.

In order to fill a container which is fitted with a valve of this type, the nose 17 of the filling machine is first brought into position (as shown in FIG. 3) against the valve cup 2 with interposition of an O-ring seal 18 and the valve stem 6 is displaced downwards to its bottom position (valve-opening position). The product which is injected under pressure flows rapidly in the direction shown by the arrows F through the opening formed by the annular flange which surrounds the valve stem, passes around the gasket 3 and penetrates into the container through the openings 11. To a lesser extent, the product under pressure is also admitted into the container through the valve proper as shown by the arrows G, that is to say through the tubular valve stem 6, through the flow passage 19 pierced in said stem, through the internal chamber 8 of the valve housing and through the dip tube 9.

Once the container has been filled, a conventional hand-operated actuator button with or without spray discharge nozzle is fitted on the valve stem 6.

When the actuator button is depressed, the product under pressure is dispensed as follows:

(a) in the case of the liquid phase: through the dip tube 9, the valve housing chamber 8, the flow passage 19 and the tubular valve stem 6;

(b) in the case of the gas phase (propellant gas within the container): through the calibrated orifice 12, the admission chamber 13, the valve housing chamber 8 in the vicinity of the gasket 3, the flow passage 19, the tubular valve stem 6.

In fact, the flow path which is common to both phases begins at the top portion of the valve housing chamber 8 and continues with the flow passage 19 and the valve stem 6.

As can readily be understood, the invention is not limited to the embodiment hereinabove described with reference to the accompanying drawings. Depending on the applications which are contemplated, consideration can accordingly be given to many alternative forms of construction without thereby departing either from the scope or the spirit of the invention.

We claim:

1. An aerosol valve having an additional-gas tap and a valve stem which is displaceable by hand in opposition to a restoring spring from a closed position to a temporarily open position for dispensing a product from a container, wherein said valve comprises: a valve cup to be crimped on the container; a valve housing having outer and inner concentric annular bearing walls which are relatively displaced in height and which are connected together by an annular base; a gasket having a diameter greater than the diameter of said inner wall and less than the diameter of said outer wall and said gasket being traversed by said valve stem, said outer bearing wall being applied directly against said valve cup and adapted to contain said gasket, said inner bearing wall being applied against said gasket so as to form an internal chamber which communicates with the product to be dispensed; said annular base between said two bearing walls being pierced by a plurality of openings for filling the container by means of a flow which passes around said gasket and said internal chamber of the valve housing, and said annular base being pierced by at least one independent calibrated orifice for the flow of propellant gas from a headspace in the container above the product; and means for defining an admission chamber between said bearing walls for coupling said calibrated orifice to said internal chamber.

2. A valve according to claim 1, wherein said valve comprises five filler openings uniformly spaced along the same circumference.

3. A valve according to claim 1, wherein said calibrated orifice is located between two of the filler openings.

4. A valve according to claim 1, wherein said valve comprises bosses carried by the inernal face of the outer bearing wall of the valve housing and located within the intervals between the filler orifices, said bosses being intended to ensure centering of the gasket and to permit the flow of propellant gas between the spaces formed by the intervals between said bosses for the purpose of filling a container fitted with said valve.

5. An aerosol container, wherein said container is equipped with a valve having the characteristics defined in claim 1.

6. An aerosol valve having an additional-gas tap and a valve stem which is displaceable by hand in opposition to a restoring spring from a closed position to a temporarily open position for dispensing a product from a container, wherein said valve comprises: a valve cup to be crimped on the container; a valve housing having outer and inner concentric annular bearing walls which are relatively displaced in height and which are connected together by an annular base; a gasket having a diameter greater than the diameter of said inner wall and less than the diameter of said outer wall, and said gasket being traversed by said valve stem, said outer bearing wall being applied directly against said valve cup and adapted to contain said gasket, said inner bearing wall being applied against said gasket so as to form an internal chamber which communicates with the product to be dispensed; said annular base between said two bearing walls being pierced by a plurality of openings for filling the container by means of a flow which passes around said gasket and said internal chamber of the valve housing, and said annular base being pierced by at least one independent calibrated orifice to receive a flow of propellant gas from a headspace in the container above the product; and a separate admission chamber defined between said two bearing walls of the valve housing, said admission chamber comprising two traverse walls extended between said bearing walls and said gasket, said admission chamber being adapted to communicate said calibrated orifice with said internal chamber through a port formed in said inner bearing wall between said traverse walls, the cross-sectional area for flow through said port being much greater than that of said calibrated orifice.

* * * * *